US005562410A

United States Patent [19]

Sachs et al.

[11] Patent Number: 5,562,410

[45] Date of Patent: Oct. 8, 1996

[54] SELF-ALIGNING HOT-PLUGGABLE FAN ASSEMBLY

[75] Inventors: Ernest J. Sachs, Framingham; Lee Spechts, Billerica; Paul Tirrell, Uxbridge, all of Mass.

[73] Assignee: EMC Corporation, Hopkinton, Mass.

[21] Appl. No.: 195,996

[22] Filed: Feb. 10, 1994

[51] Int. Cl.[6] ..... F04D 29/60

[52] U.S. Cl. ..... 415/213.1; 454/184; 361/695

[58] Field of Search ..... 415/213.1, 223; 454/184; 312/223.1; 361/687, 695

[56] References Cited

U.S. PATENT DOCUMENTS

| | | | |
|---|---|---|---|
| 4,744,005 | 5/1988 | Milani | 454/184 |
| 4,751,872 | 6/1988 | Lawson, Jr. | 454/184 |
| 4,899,254 | 2/1990 | Ferchau et al. | 361/695 |
| 5,087,932 | 2/1992 | Chikano | 361/695 |
| 5,207,613 | 5/1993 | Ferchau et al. | 454/184 |
| 5,308,156 | 5/1994 | Gutierrez | 454/184 |
| 5,340,340 | 8/1994 | Hastings et al. | 312/223.1 |

FOREIGN PATENT DOCUMENTS

| | | | |
|---|---|---|---|
| 0161103 | 12/1979 | Japan | 415/213.1 |

*Primary Examiner*—Edward K. Look
*Assistant Examiner*—Mark Sgantzos
*Attorney, Agent, or Firm*—Daniel J. Bourque, Esq.; Kevin J. Carroll, Esq.

[57] ABSTRACT

A hot-pluggable cabinet cooling fan assembly is mounted to an exterior face of a cabinet in such a way as to enable removal or service of the fan assembly without either disrupting the operation of the cabinet being cooled or opening of cabinet doors. First and second plugs are provided on confronting faces of the fan assembly and the exterior face of the cabinet. Mechanical elements are carried by the confronting faces that prealign the plugs, while other mechanical elements are carried by the plugs that finely align the electrical connection elements of the plugs. A handle is provided that allows single-handed fan assembly mounting and dismounting.

11 Claims, 3 Drawing Sheets

FIG. 3

SELF-ALIGNING HOT-PLUGGABLE FAN ASSEMBLY

FIELD OF THE INVENTION

This invention is directed to the field of heat transfer, and more particularly, to a self-aligning hot-pluggable fan and fan cabinet assembly.

BACKGROUND OF THE INVENTION

Many electronic and computer systems devices have electrical components that require convective cooling. The components are typically mounted inside cabinets and one or more internal fans provide the measure of convective cooling needed to maintain the operating temperature of the components within prescribed ranges. However, to repair or replace the cooling fans, the cabinets have had to be opened to access the cooling fans and the electronic and computer systems have had to be turned off, thereby preventing the user from utilizing the sometimes critical, systems.

It is thus desirable to provide a non-disruptive fan and cabinet assembly so that the system being cooled stays "on", even while service is being performed on the cooling fans, without having to open the cabinet to effectuate the repair.

SUMMARY OF THE INVENTION

It is accordingly the principal object of the present invention to provide a self-aligning, hot-pluggable fan and cabinet assembly that enables non-disruptive repair and/or replacement while service is being performed without the need to open the system cabinet. In accord therewith is disclosed a fan assembly which is removably mounted to the exterior face of the system cabinet. Also provided are connecting means mounted to the fan assembly and to the system cabinet, for electrically connecting and powering the fan assembly when the same is mounted to the cabinet, and for electrically disconnecting the fan assembly when it is dismounted from the system cabinet.

In the preferred embodiment, the exterior face of the cabinet to which the fan assembly is mounted is the top face thereof. The removably mounted fan assembly thereby enables the fan to be replaced and/or repaired without opening the cabinet.

In the preferred embodiment, the disclosed electrical connecting means includes plugs having mating connection elements respectively mounted to the fan assembly and cabinet, and including means for aligning the connection elements of the plugs during mounting and dismounting of the fan assembly to and from the cabinet. In this manner, not only is the fan assembly blind-mateable with the cabinet, but it may also be mounted and dismounted therefrom while the machine is still "on" in a "hot-pluggable" mode.

In the preferred embodiment, the aligning means includes mating mechanical elements on the fan assembly and cabinet such that when mated during mounting of the fan assembly to the cabinet, the mechanical elements roughly align the plugs of the fan and cabinet. The mechanical elements further include mating mechanical posts and slots on the plugs themselves that ensure the precise alignment of the connector elements. A handle is mounted to the fan assembly that is able to be manipulated by one hand which thereby frees the other hand of the individual repairing the fan assembly for use as a stabilizer such that while the fan is pulled off the assembly with one hand the other hand may hold on to the cabinet while removing the fan unit.

DESCRIPTION OF THE DRAWINGS

Other objects, features and advantages of the present invention will become apparent by reference to the following detailed description of the preferred embodiment thereof and to the drawings, wherein.

DETAILED DESCRIPTION OF THE PREFERRED EMBODIMENT

Figure 1A:
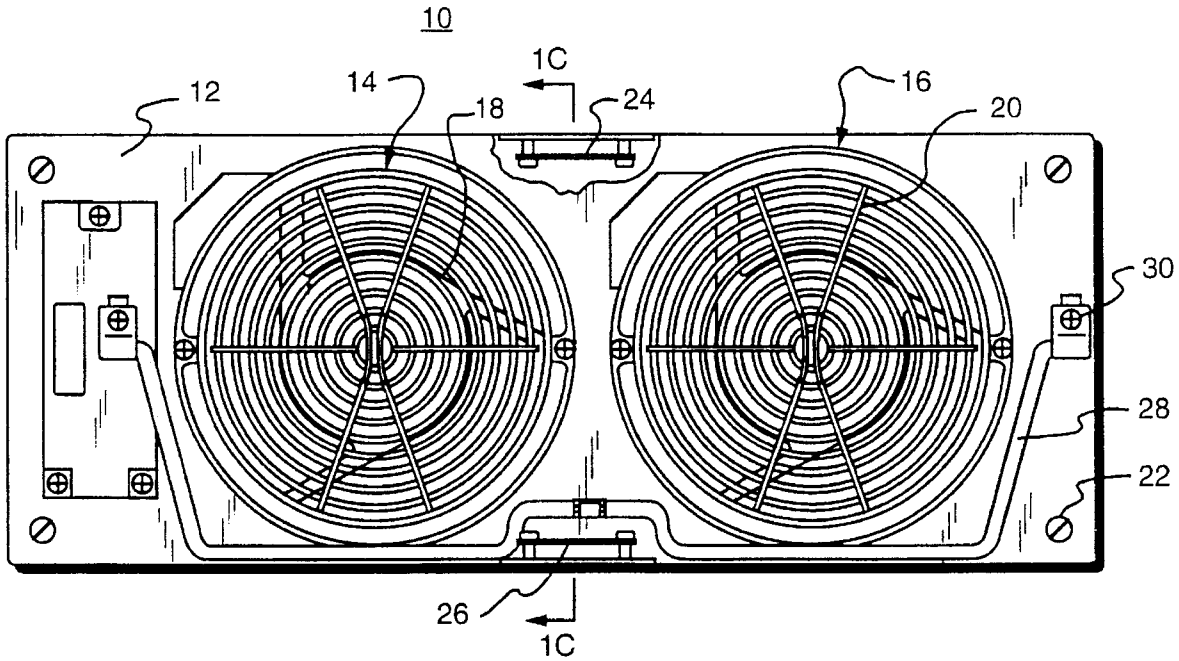
FIG. 1A is a top plan view, FIG. 1B a side elevational view, and FIG. 1C an end elevational view of the self-aligning, hot-pluggable fan assembly of the present invention.
Figure 1B:
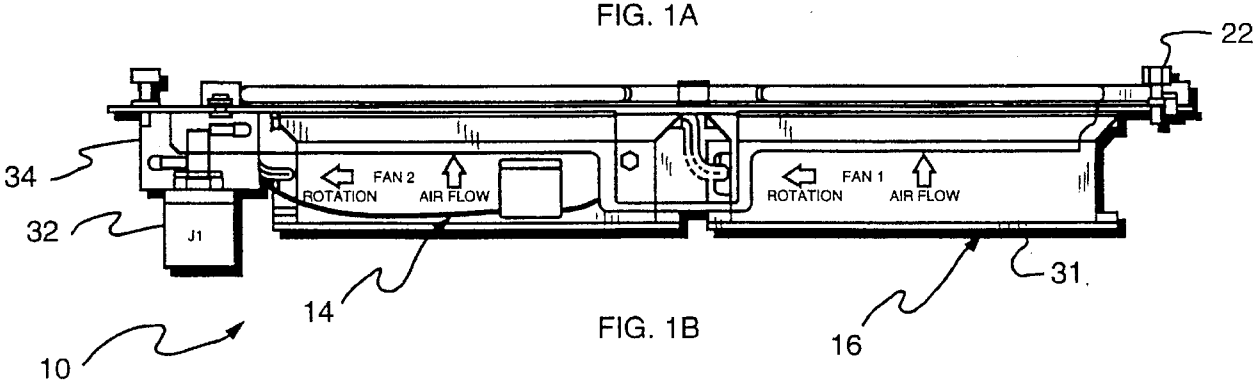
Figure 1C:
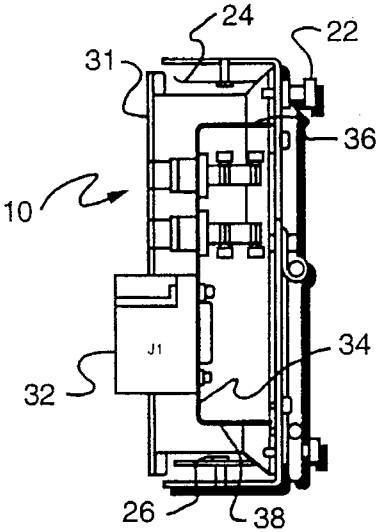

Referring now to FIGS. 1A, 1B and 1C, generally designated at 10 is the self-aligning hot-pluggable fan assembly of the present invention. The fan assembly 10 includes a frame member 12 fashioned of any suitable material, such as sheet metal or aluminum, to which multiple fan units such as first and second fan units generally designated 14, 16 are fastened. Each fan unit 14, 16 includes a rotatable impeller 18 (FIG. 1A) and a fan guard 20 fastened to the frame 12 and over the impeller 18 of the fan units 14, 16. Although two (2) fan units are disclosed in the presently preferred embodiment, a different number of fan units (one or more) may be employed without departing from the inventive concept.

The frame member 12 in the exemplary embodiment is generally rectangularly shaped and four (4) quick-release bolts 22 are provided proximate a different corner of the rectangular frame member 12 in the exemplary embodiment as means for removably and disengagingly mounting the fan assembly to an electronic cabinet. The quick-release bolts 22 enable each fan module 10 to be quickly and easily secured to and removed from an exterior face of the cabinet to be cooled in a manner to be described. Other means including channels, mating studs and holes, screws and similar systems or devices may also be provided to removably mount a fan assembly to the cabinet and are considered to be within the scope of the present invention. One example of a quick-release bolt 22 is a spring-loaded threaded bolt having a spring 21 positioned around the bolt 22. Printed circuit boards 24, 26 are mounted to the frame member 12, one (1) for each of the fan units 14, 16. The printed circuit boards 24, 26 are supplied with power by the cabinet and monitor and control the operational condition of the fans once the fan assembly has been positioned on the cabinet and engaged with a mating connection on the electronic cabinet. The printed circuit boards may include a circuit to alert the system of a malfunctioning fan, as is well known in the art.

A handle member 28 is provided on the exposed face of the fan assembly 10. The handle member 28 is pivotally mounted at each of its ends to a bracket 30 fastened to the exposed face of the frame member 12. The handle 28 enables the fan assembly 10 to be removed from the cabinet to be cooled with the use of a single hand, enabling the use of the other hand to hold against the cabinet to free the fan assembly and to maintain balance. Any other suitable handle and hand handle mounting means may be employed without departing from the inventive concept of the present invention.

A first plug 32 is mounted to a plug frame or support box 34 that is fastened to the frame 12 proximate one (1) of its ends in such a way that the plug 32 projects beyond the inside surface 31 of the fan assembly 10. The plug 32 is electrically connected to the fan units 14, 16 through respective printed circuit boards 24, 26. The plug 32 supplies the electrical connection to the fan units 14, 16 whenever it is mated with a corresponding second plug to be described provided on the cabinet or system to be cooled. Any suitable plug 32, such as the so-called drawer plug commercially available from AMP Corporation, may be employed. The plug frame 34 includes corner edges or portions 36, 38 (FIG. 1C) that cooperate or mate with detents of a cabinet mounting flange to be described, to provide rough alignment of the plug 32 with its mating plug in the cabinet. Although the corners of the plug frame 34 provide the rough mechanical alignment in the preferred embodiment, other mechanical aligning means may be employed without departing from the inventive concept. Additionally, exterior or edges of plug 32 itself may serve as the rough mechanical alignment means which merely serves to prevent pre-align the electrical contacts inside plug 32 to prevent damage to the electrical contacts in the plug or their mating connections on the cabinet to be cooled.

Figure 2:
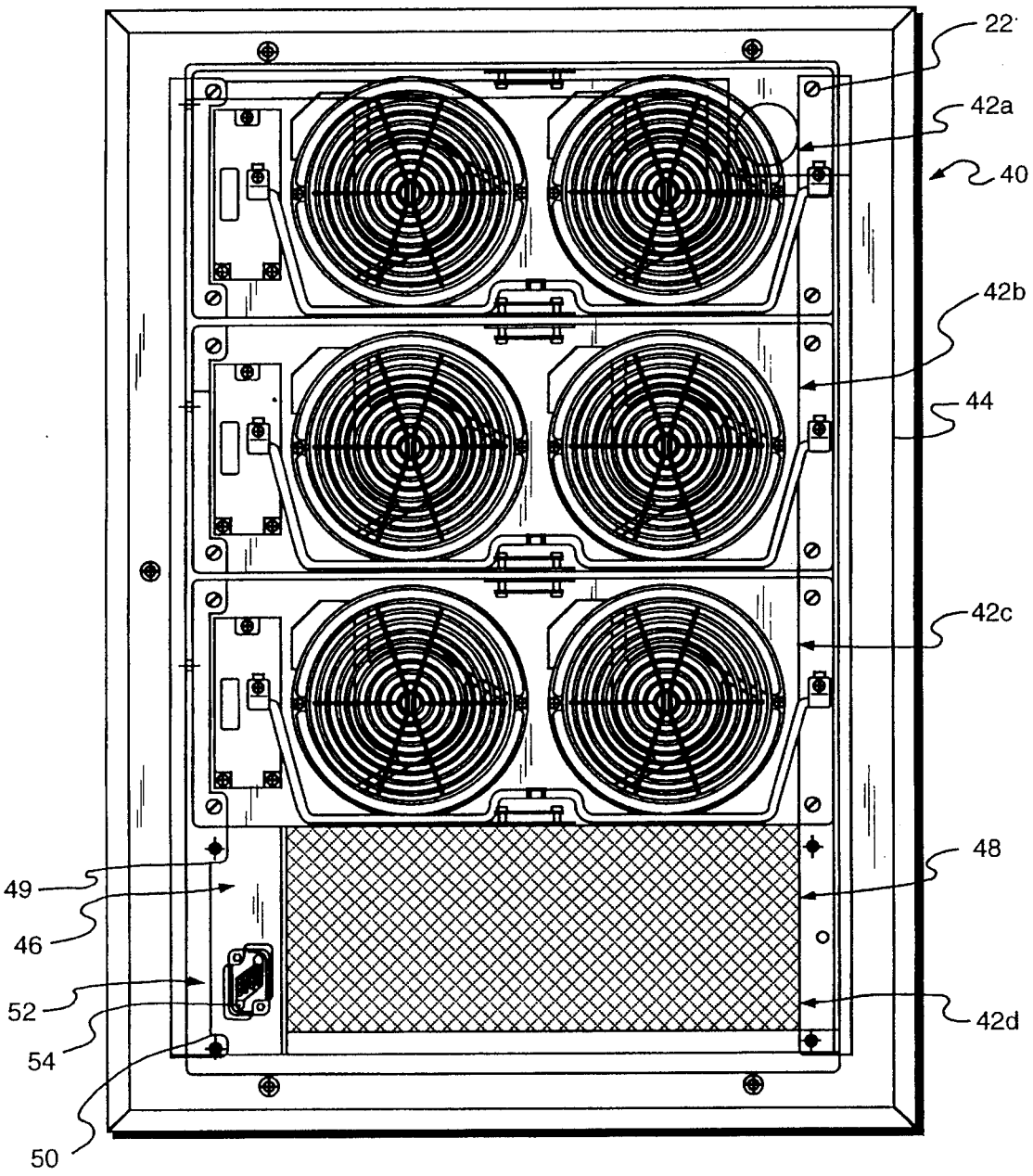
FIG. 2 is a partially cut away top plan view of the self-aligning hot-pluggable fan assembly of the present invention with one fan assembly removed.

Referring now to FIG. 2, generally designated at 40 is a partially cut away top plan view of multiple self-aligning, hot-pluggable, fan assemblies according to the present invention. Three (3) fan assemblies generally designated 42*a*–42*c* are shown at the top of and mounted to an electrical or computer type cabinet assembly 44 having an exterior face, with one (1) of the fan assemblies 42(*d*) removed. The fan assemblies 42*a*–42*d* can be replaced without opening up the cabinet 44 simply by disengaging the threaded bolts 22 (FIG. 1) provided at each of the four (4) corners of the frame element of the fan modules 42*a*–42*d*. Although four (4) fan modules are shown located at the top face of the cabinet 44, it will be appreciated that a different number of fan modules may be utilized and that they may be placed at a different exterior face of the cabinet 44 without departing from the inventive concept.

First and second mounting flanges generally designated 46, 48 are mounted to the cabinet 44 for each fan unit 42 to be mounted thereto. The flanges 46, 48 of the cabinet 44 are each provided with two (2) threaded apertures 45, 47 at the respective ends thereof, each threaded aperture for receiving one of the threaded bolts 22 (FIG. 1) of the frame of each fan assembly 42*a*–42*d*. In one embodiment, the flange 46 is provided with detents 49, 50 that mate with the corner edges 36, 38 (FIG. 1C) of the plug support or frame 34 of the corresponding fan module to provide alignment of the first plug 32 with a second mating drawer plug 52 mounted to the chassis 44.

The fan assemblies 42 are thereby blind-mateable to the top of the cabinet 44 in a manner that ensures corresponding mechanical alignment of the corresponding fan module plug 32 (FIG. 1) and cabinet mounted mating drawer plug generally designated 52. Although detents 49, 50 provide the rough mechanical alignment of the matching drawer plugs of each fan module with the cabinet, any other suitable mechanical alignment means may be employed without departing from the inventive concept.

Each drawer plug 52 includes plug alignment means such as upstanding alignment posts 54 that cooperate and mate with slots or holes provided therefor in each mating connector 32 (FIGS. 1B, 1C) to provide the fine-alignment of the corresponding connector elements of the mating plugs whenever the fan modules are mated to the cabinet 44. Any suitable alignment means such as the drawer plug commercially available from AMP Corporation may be employed to provide fine-alignment of the connector elements without departing from the inventive concepts.

Figure 3:
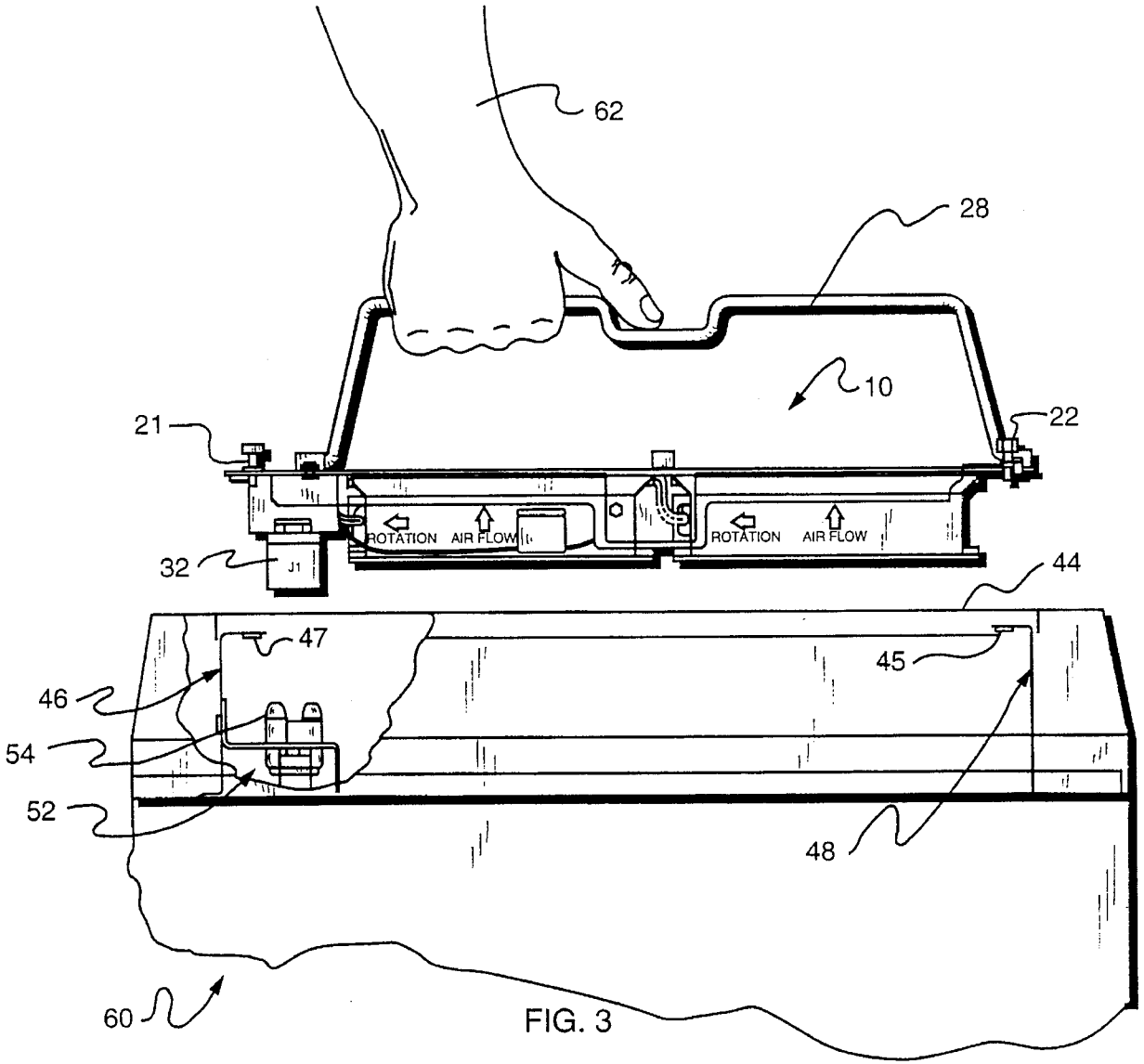
FIG. 3 is a partially cut away and exploded end elevational view of the self-aligning, hot-pluggable fan assembly of the present invention.

Referring now to FIG. 3, generally designated at 60 is a partially cut away and exploded end elevational view of the self-aligning, hot-pluggable, fan assembly of the present invention. In use, a fan module 10 is gripped by one (1) hand 62 of a user to mount and dismount the fan module 10 from the top of the cabinet 44. The threaded fasteners 22 are either threaded in or threaded out of the apertures provided therefor on the flanges 46, 48 to secure and remove the fan unit 10.

During mounting, the edges 36, 38 (FIG. 1C) of the box 34 (FIGS. 1B, 1C) to which the plug 32 is mounted engage with the detents 49, 50 (FIG. 2) of the flange 46 to align the plug 32 with the corresponding plug 52. During mounting, the posts 54 of the plug 52 are received in apertures provided therefor on the plug 32 that ensure the fine-alignment of the connector elements of the mating drawer plugs 32, 52.

The fan assembly 10 may be replaced while the machine is "on" and replaced and/or repaired without opening up the cabinet 44. The fan assembly 10 and cabinet are self-aligning, so that they may be blind-mated and unmated using only one (1) hand of the operator, which frees the other hand to be rested against the cabinet 44 so as to provide leverage or balance and support.

Many modifications of the presently disclosed invention will become apparent to those skilled in the art with the benefit of the foregoing description.

What is claimed is:

1. A hot-pluggable cabinet cooling fan assembly, comprising:

a fan assembly;

means for removably disengagably mounting said fan assembly to an exterior face of a cabinet to be cooled without opening said cabinet; and means, mounted to said fan assembly and to said cabinet, for electrically connecting said fan assembly to a source of electrical power when said fan assembly is mounted to said exterior face of said cabinet to be cooled, and for electrically disconnecting said fan assembly from said source of electrical power when said fan assembly is dismounted therefrom.

2. A hot-pluggable cabinet cooling fan assembly, comprising:

a fan assembly;

a fan assembly mount, for removably disengagably mounting said fan assembly to an exterior face of a cabinet to be cooled without opening said cabinet;

at least one fan assembly connector assembly, for electrically connecting said fan assembly to a source of electrical power when said fan assembly is mounted to said exterior face of said cabinet, and for electrically disconnecting said fan assembly from said source of electrical power when said fan assembly is dismounted from said exterior face of said cabinet, said at least one connector assembly including:

first and second plugs having mating connector elements mounted to confronting faces of said fan assembly and said exterior face of said cabinet respectively, each of said mating connector elements having mating connector element alignors including cooperative mechanical elements respectively provided on the confronting faces of said fan assembly and the exterior face of said cabinet, for mechanically aligning said mating connector elements.

3. A hot-pluggable cabinet cooling fan assembly, comprising:

a fan assembly;

means for removably mounting said fan assembly to an exterior face of a cabinet to be cooled without opening said cabinet; and means, mounted to said fan assembly and to said cabinet, for electrically connecting said fan assembly to a source of electrical power when said fan assembly is mounted to said exterior face of said cabinet to be cooled, and for electrically disconnecting said fan assembly from said source of electrical power when said fan assembly is dismounted therefrom, said electrical connecting means including:

first and second plugs having mating connector elements respectively mounted to confronting faces of said fan assembly and said exterior face of said cabinet, wherein said first plug is mounted to a plug support frame on said fan assembly; and means for aligning the connector elements of said first and second plugs during mounting of said fan assembly to said exterior race of said cabinet, said aligning means including corner edges on said plug support frame and mating corner edge receiving regions on said cabinet to be cooled, whereby said mating corner edge receiving regions abut said corner edges to align said first and second plugs when said fan assembly is mounted to the cabinet.

4. The fan assembly of claim 1, wherein said fan assembly includes two (2) fan units, each fan unit including an impeller and a fan guard.

5. The fan assembly of claim 1, wherein said exterior face of said cabinet includes a top face.

6. The fan assembly of claim 1, wherein said fan assembly includes a fan frame member, and wherein said means for removably mounting include threaded fasteners mounted to said fan frame member and at least one flange mounted to said cabinet, said flange having apertures that mate with said threaded fasteners mounted to said frame member of said fan assembly.

7. The fan assembly of claim 6, wherein said threaded fasteners include quick-release, spring-loaded threaded bolts.

8. The fan assembly of claim 1, wherein said electrical connecting means includes first and second plugs having mating connector elements respectively mounted to confronting faces of said fan assembly and said exterior face of said cabinet, and further including means for aligning the connector elements of said first and second plugs during mounting of said fan assembly to said exterior face of said cabinet.

9. The fan assembly of claim 8, wherein said mating connector element aligning means include cooperative mechanical elements respectively provided on the confronting faces of the fan assembly and the exterior face of said cabinet, said cooperative mechanical elements cooperating to align the first and second plugs.

10. The fan assembly of claim 8, wherein said fan assembly includes a frame, and said cabinet subassembly includes a frame, and wherein the aligning means includes mating frame elements on the fan assembly frame and cabinet frame that when mated, roughly align said plugs.

11. The fan assembly of claim 10, wherein at least one of said plugs is provided with a post and the other of said plugs is provided with a post receiving region such that when the fan assembly is mounted to the cabinet, said post is received in said post receiving region, ensuring the precise alignment of the connector elements of the first and second plugs.

* * * * *